US008152634B2

(12) United States Patent
Gagner et al.

(10) Patent No.: US 8,152,634 B2
(45) Date of Patent: Apr. 10, 2012

(54) SWITCHING OPERATION MODES IN MOBILE WAGER GAMING DEVICES

(75) Inventors: Mark B. Gagner, West Chicago, IL (US); Vernon W. Hamlin, Lisle, IL (US); Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 805 days.

(21) Appl. No.: 12/295,395

(22) PCT Filed: Mar. 27, 2007

(86) PCT No.: PCT/US2007/007688

§ 371 (c)(1),
(2), (4) Date: Sep. 30, 2008

(87) PCT Pub. No.: WO2007/126894

PCT Pub. Date: Nov. 8, 2007

(65) Prior Publication Data

US 2009/0170596 A1 Jul. 2, 2009

Related U.S. Application Data

(60) Provisional application No. 60/744,069, filed on Mar. 31, 2006.

(51) Int. Cl.
*A63F 9/24* (2006.01)

(52) U.S. Cl. ..... 463/29; 463/41; 463/42

(58) Field of Classification Search ..... 463/41, 463/42, 29

See application file for complete search history.

(56) References Cited

U.S. PATENT DOCUMENTS

| | | | | |
|---|---|---|---|---|
| 5,999,808 | A * | 12/1999 | LaDue | 455/412.2 |
| 6,846,238 | B2 * | 1/2005 | Wells | 463/39 |
| 7,510,474 | B2 * | 3/2009 | Carter, Sr. | 463/29 |
| 7,611,409 | B2 * | 11/2009 | Muir et al. | 463/29 |
| 2001/0034237 | A1 * | 10/2001 | Garahi | 455/456 |
| 2003/0006931 | A1 * | 1/2003 | Mages | 342/357.06 |
| 2005/0130728 | A1 * | 6/2005 | Nguyen et al. | 463/16 |
| 2005/0181870 | A1 * | 8/2005 | Nguyen et al. | 463/29 |
| 2005/0187020 | A1 * | 8/2005 | Amaitis et al. | 463/42 |
| 2005/0197190 | A1 * | 9/2005 | Amaitis et al. | 463/42 |
| 2007/0202941 | A1 * | 8/2007 | Miltenberger et al. | 463/25 |
| 2007/0270224 | A1 * | 11/2007 | Abbott | 463/42 |
| 2008/0076572 | A1 * | 3/2008 | Nguyen et al. | 463/42 |

OTHER PUBLICATIONS

International Application Serial No. PCT/US2007/07688, Search Report mailed Jun. 10, 2008, 4 pgs.
International Application Serial No. PCT/US2007/07688, Written Opinion mailed Jun. 10, 2008, 6 pgs.

* cited by examiner

*Primary Examiner* — Dmitry Suhol
*Assistant Examiner* — David Duffy
(74) *Attorney, Agent, or Firm* — Schwegman, Lundberg & Woessner, P.A.

(57) ABSTRACT

This disclosure describes methods and wager gaming devices that can enter different operation modes based on different network connections. In one embodiment, a method includes connecting to a content provider via a first network connection, wherein connecting to the content provider via the first network connection enables a first mode of operation and prohibits a second mode of operation. The method can also include operating in the first mode of operation. The method can also include connecting to the content provider via a second network connection, wherein connecting to the content provider via the second network connection enables the second mode of operation. The method can also include operating in the second mode of operation, wherein the operating includes, presenting a wagering game upon which monetary value can be wagered.

23 Claims, 13 Drawing Sheets

SWITCHING OPERATION MODES IN MOBILE WAGER GAMING DEVICES

RELATED APPLICATION

This patent application is a U.S. National Stage Filing under 35 U.S.C. 371 from International Patent Application Serial No. PCT/US2007/007688, filed Mar. 27, 2007, and published on Nov. 8, 2007, as WO 2007/126894 A2 and republished as WO 2007/126894 A3, which claims the priority benefit of U.S. Provisional Patent Application Ser. No. 60/744,069 filed Mar. 31, 2006 and entitled "SWITCHING OPERATION MODES IN MOBILE WAGER GAMING DEVICES", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments of the inventive subject matter relate generally to wager gaming, and more particularly, to switching between operation modes in mobile wager gaming devices.

BACKGROUND

Wager gaming machines, such as slot machines, video poker machines, and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are most likely attracted to the most entertaining and exciting of the machines. Consequently, shrewd operators strive to employ the most entertaining and exciting machines available because such machines attract frequent play and increase profitability for the operator. In the competitive wager gaming machine industry, there is a continuing need for manufacturers to produce new game types or to enhance entertainment and excitement associated with existing wager gaming machines.

BRIEF DESCRIPTION OF THE FIGURES

The present invention is illustrated by way of example and not limitation in the Figures of the accompanying drawings in which.

DESCRIPTION OF THE EMBODIMENTS

Introduction

Figure 1:
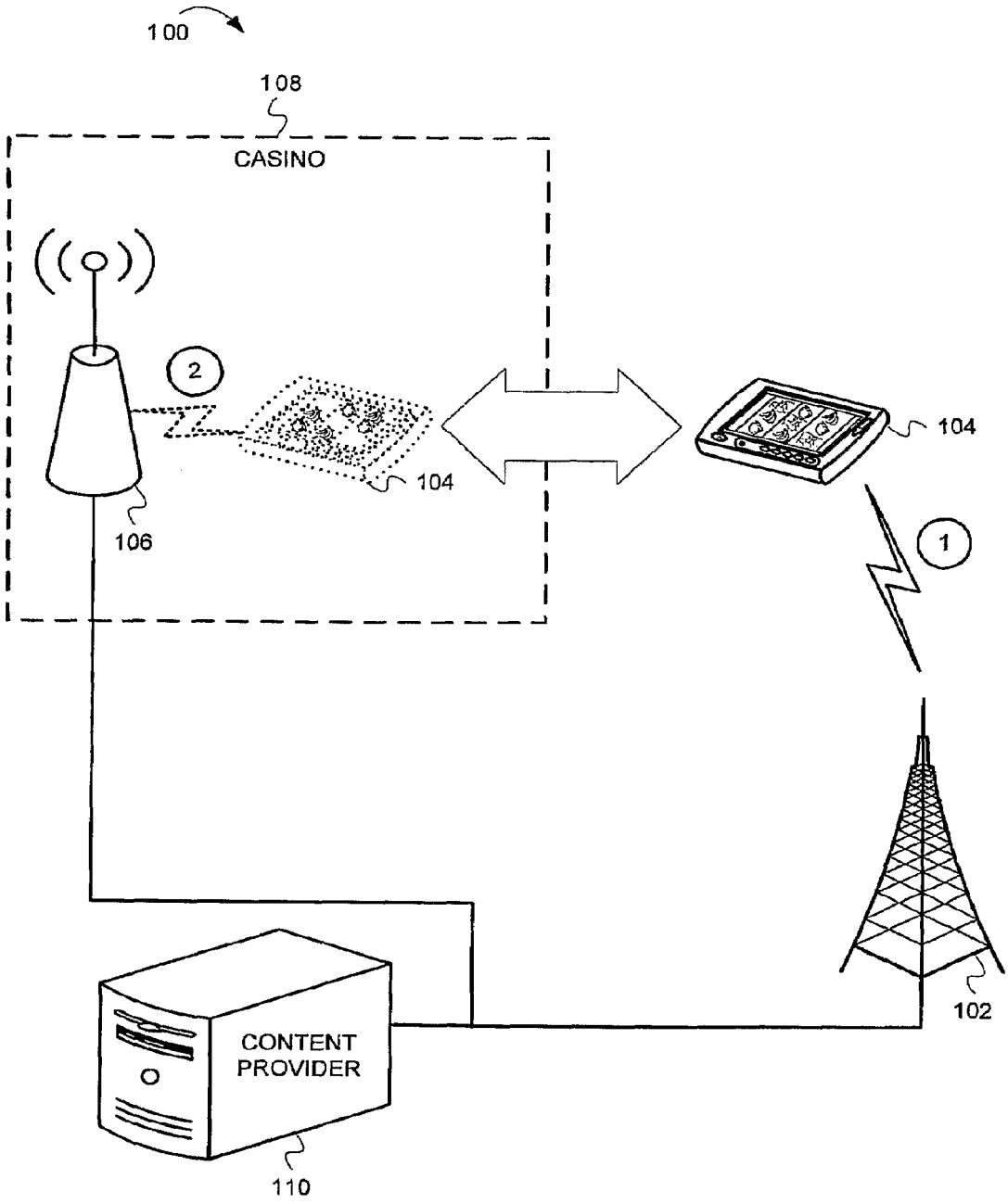
FIG. 1 is a block diagram illustrating switching between networks in a wager gaming network, according to embodiments of the invention.

This section introduces embodiments of a wager gaming network in which mobile wager gaming devices can enter different operation modes by switching between network connections. In one embodiment, a wager gaming device can connect to a content provider using one or more network connections. When the mobile wager gaming device connects over a first network connection (e.g., a cellular network connection), it may be restricted to an amusement mode in which only amusement games and non-wagering content are available. However, if the mobile wager gaming device connects to the content provider via a second network connection (e.g., a casino's 802.11g network), the mobile device may be allowed to enter a wagering mode in which wagering games (e.g., video slots, blackjack, etc.) and wagering content are available. As the mobile wager gaming device roams about, it may detect and connect to different networks. As a result, embodiments of the mobile wager gaming device can establish different network connections through which different operation modes are available. FIG. 1 describes these features in more detail.

FIG. 1 is a block diagram illustrating a mobile wager gaming device switching between network connections and operation modes, according to embodiments of the invention. As shown in FIG. 1, the wager gaming network 100 includes a mobile wager gaming device 104, wireless access point 106, cell phone tower 102, and content provider 110. As shown, the wireless access point 106 is located inside a casino 108.

FIG. 1 shows two stages. During stage one, the mobile wager gaming device 104 establishes a network connection to the content provider 110 via the cell phone tower 102. While the mobile wager gaming device 104 is connected only via the cell phone tower 102, the content provider 110 enables the mobile wager gaming device 104 to operate in a non-wagering mode and prohibits the mobile device 104 from entering a wagering mode. In the non-wagering mode, amusement games and non-wagering content are available on the mobile wager gaming device 104.

During stage two, the mobile wager gaming device 104 roams into the casino 108 and connects to the content provider 110 via the wireless access point 106. In one embodiment, the content provider 110 can detect a connection to the mobile wager gaming device 104 via the wireless access point 106. When the mobile wager gaming device 104 is connected via the wireless access point 106, the content provider 110 enables the mobile wager gaming device to enter a wagering mode in which wagering games and wagering game content are available.

In the following sections, this description will describe these and other embodiments of the invention in greater detail.

Example Operating Environment

This section describes an example operating environment in which embodiments of the invention can be practiced. This section will present example network, mobile wager gaming device, and content server architectures.

Example Network

Figure 2:
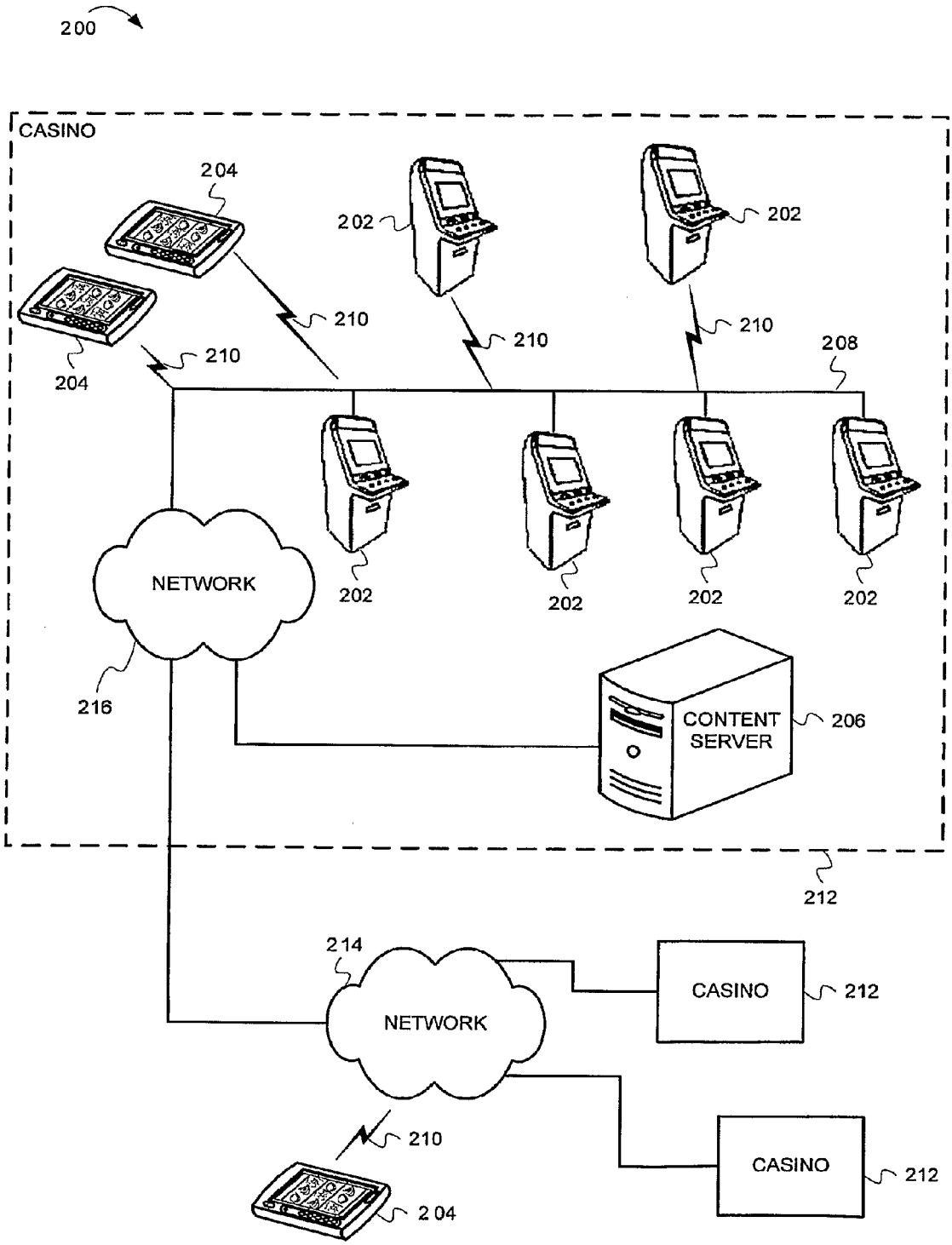
FIG. 2 is a block diagram illustrating a wager gaming network, according to example embodiments of the invention.

FIG. 2 is a block diagram illustrating a wager gaming network, according to example embodiments of the invention. As shown in FIG. 2, the wager gaming network 200 includes a plurality of casinos 212 connected to a communications network 214. Each of the plurality of casinos 212 includes a local area network 216, which includes wager gaming machines 202, mobile wager gaming devices 204, and a content server 206. The wager gaming machines 202, mobile wager gaming device 204, and content server 206 can include hardware and machine-readable media including instructions for switching between operation modes based on network connections, as described herein. In one embodiment, the content server 206 can facilitate switching between networks in concert with serving wagering games over the local area network 216.

The wager gaming machines described herein can take any suitable form, such as floor standing models, mobile units, bartop models, workstation-type console models, etc. In one embodiment, the wager gaming network 200 can include other network devices, such as accounting servers, wide area progressive servers, and/or other devices suitable for use in connection with embodiments of the invention.

The components of each casino 212 can communicate over wired 208 and/or wireless connections 210. Furthermore, they can employ any suitable connection technology, such as Bluetooth, IEEE 802.11, Ethernet, public switched telephone networks, SONET, etc.

Example Mobile Wager Gaming Device Architecture

Figure 3:
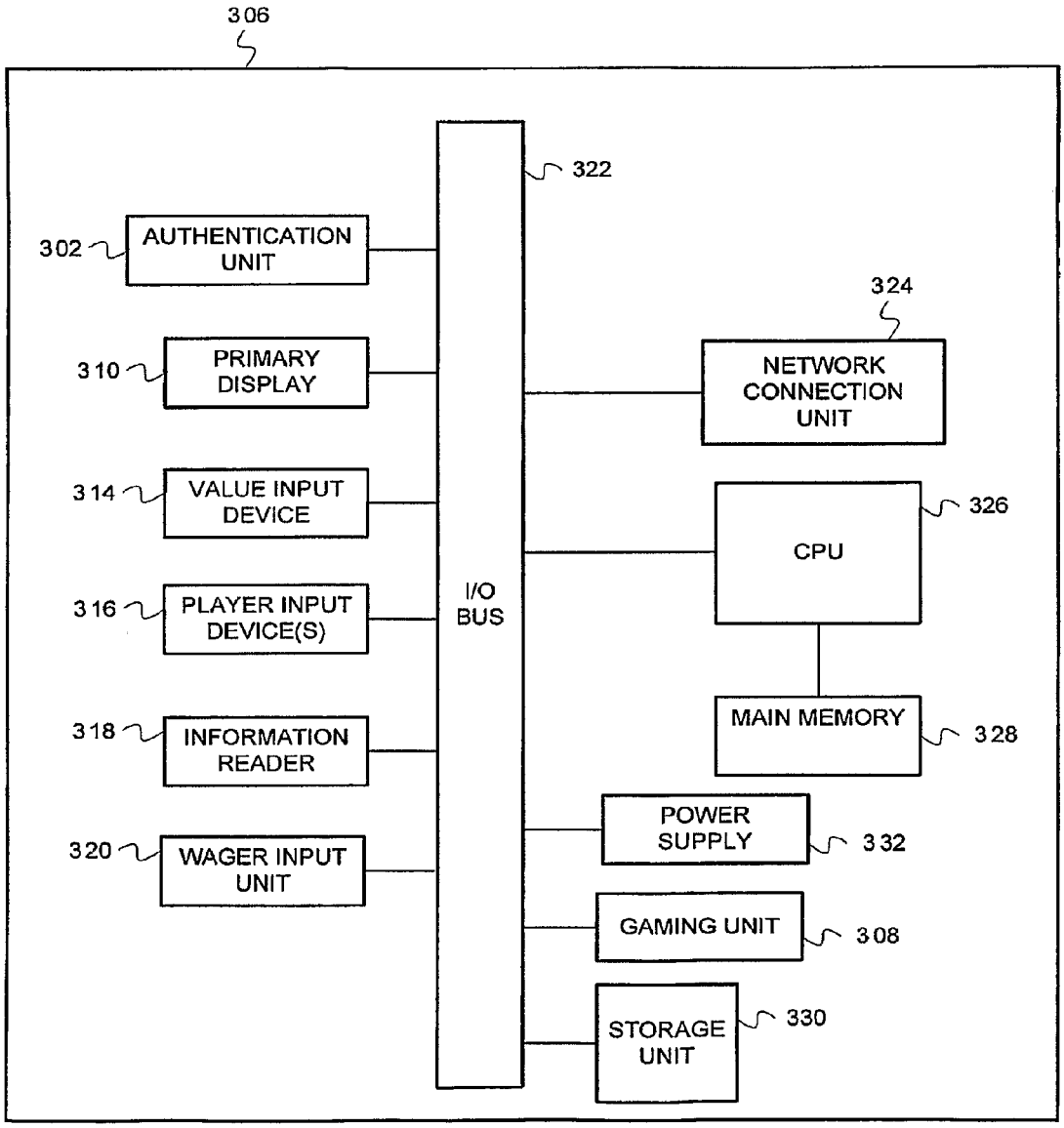
FIG. 3 is a block diagram illustrating an example mobile wager gaming device architecture, according to example embodiments of the invention.

FIG. 3 is a block diagram illustrating an example mobile wager gaming device architecture, according to example embodiments of the invention. As shown in FIG. 3, the mobile wager gaming device 306 includes a central processing unit (CPU) 326 connected to main memory 328. The CPU 326 is also connected to an input/output (I/O) bus 322, which is connected to a power supply 332. The I/O bus 322 facilitates communication between and distributes power to the mobile wager gaming device's components. In one embodiment, the power supply 332 includes a rechargeable battery, such as a nickel cadmium battery.

The I/O bus 322 is connected to a gaming unit 308 that can receive wagers and present wagering games, such as video poker, video blackjack, video slots, video lottery, etc. The gaming unit 308 can also present non-wagering games (e.g., amusement games) and present non-wagering game content (e.g. non-wagering web pages). The I/O bus 322 is also connected to a network connection unit 324, which includes logic for connecting to a content provider via a plurality of network connections, as described herein. The network connection unit 324 can work in concert with an authentication unit 302, which includes logic for authenticating user and network credentials. Additionally, the I/O bus 322 is connected to a primary display 310, value input device 314, player input device(s) 316, information reader 318, wager input unit 320, and storage unit 330.

In one embodiment, the mobile wager gaming device 306 can include additional peripheral devices and/or more than one of each component shown in FIG. 3. For example, in one embodiment, the mobile wager gaming device 306 can include multiple network connection units 324 and multiple CPUs 326. In one embodiment, any of the components can be combined or divided. Additionally, in one embodiment, the components of the mobile wager gaming device 306 can be interconnected according to any suitable interconnection architecture (e.g., bus architecture, directly connected, hypercube, etc.).

In one embodiment, any of the components of the mobile wager gaming device 306 (e.g., the network connection unit 324) can include hardware, firmware, and/or software for performing the operations described herein. In one embodiment, any of the mobile wager gaming device's components can be embodied as instructions stored on a machine-readable medium, where the instructions are executable on the CPU 326. Machine-readable media can include any mechanism that provides (i.e., stores and/or transmits) information in a form readable by a machine (e.g., a mobile wager gaming device, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Content Server Architecture

Figure 4:
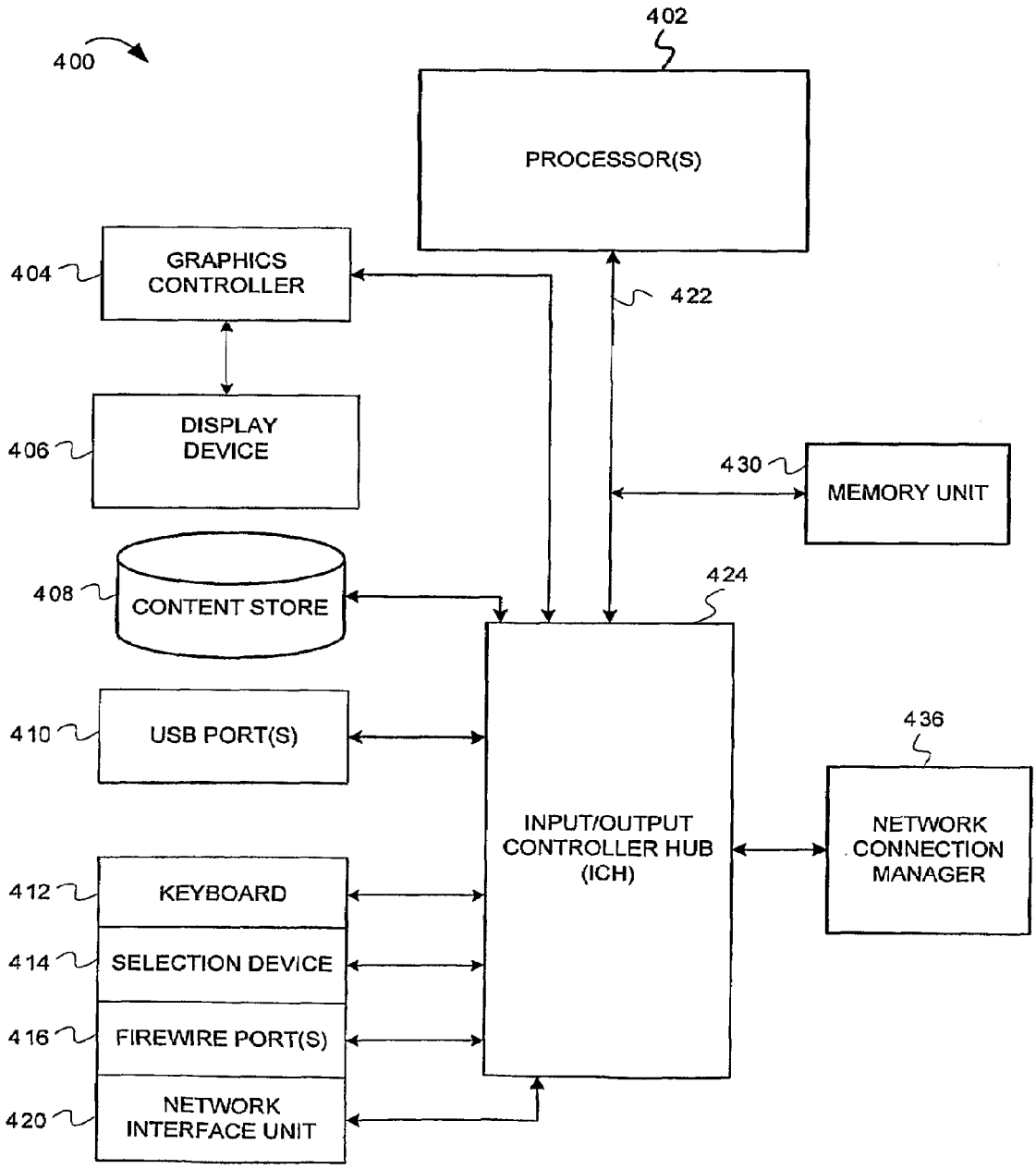
FIG. 4 illustrates a content server architecture, according to example embodiments of the invention.

FIG. 4 illustrates a content server architecture, according to example embodiments of the invention. As illustrated in FIG. 4, the content server 400 comprises processor(s) 402, memory unit 430, processor bus 422, and Input/Output controller hub (ICH) 424. The processor(s) 402, memory unit 430, and ICH 424 are coupled to the processor bus 422. The processor(s) 402 can be of any suitable processor architecture (e.g., CISC, RISC, etc.).

The memory unit 430 can store data and/or instructions and can comprise any suitable memory type, such as a dynamic random access memory (DRAM). A graphics controller 404 can control display of information on a display device 406, according to embodiments of the invention.

The content server 400 also includes a content store 408 for storing wager gaming and non-wager gaming content. The wager gaming content can include instructions and/or data for presenting wagering games (e.g., video slots, video poker, video blackjack, and the like), whereas the non-wager gaming content can include instructions and/or data for presenting amusement games. Both the wager gaming content and non-wagering game content can include program code, audio content, video content, language content, text, etc. The wagering and non-wagering content can also include executable code, operating system code, interpretable scripts, byte codes, assembly instructions, game math, art, configuration data (enumerating allowable percentages, denominations, paylines, etc.), operating system features, peripheral device drivers, attract mode displays, advertisements, episodic game content, etc.

In one embodiment, the ICH 424 is connected to a network interface unit 420 though which the content server 400 can communicate with other computers and mobile wager gaming devices. The ICH 424 is also connected to a network connection manager 436, which can enable mobile wager gaming devices to operate in different modes based on the mobile devices' network connections. For example, if a mobile wager gaming device is connected to the content server 400 via a GSM network connection, the network connection manager 436 may constrain the mobile wager gaming device to a non-wagering mode of operation. However, if a mobile wager gaming device connects to the content server 400 via a known casino's 802.11g network, the network connection manager 436 may allow the mobile wager gaming device to enter a wagering mode of operation.

The input/output controller hub (ICH) 424 provides an interface to I/O devices or peripheral components for the content server 400. The ICH 424 can comprise any suitable interface controller to provide for a communication link to the processor(s) 402, memory unit 430, and/or any suitable device or component. In one embodiment, the ICH 424 provides suitable arbitration and buffering for each interface.

In one embodiment, the ICH 424 provides an interface to one or more suitable persistent storage devices (e.g., content store 408), DVD drives (not shown), or universal serial bus (USB) devices through one or more USB ports 410. In one embodiment, the ICH 424 also provides an interface to a keyboard 412, selection device 414, and other devices through firewire ports 416.

In one embodiment, the content server 400 includes a machine-readable medium that stores a set of instructions (e.g., software) embodying one or more of the methods for enabling operation modes based on a mobile wager gaming device's network connections. Furthermore, software can reside, completely or at least partially, within memory unit 430 and/or within the processor(s) 402.

Example Operations

This section describes operations performed by embodiments of the invention. In the discussion below, the flow diagrams will be described with reference to the block diagrams presented above. In certain embodiments, the operations are performed by instructions residing on machine-readable media (e.g., software), while in other embodiments, the operations are performed by hardware and/or other logic (e.g., firmware). In some embodiments, the operations are performed in series, while in other embodiments the operations can be performed in parallel. Furthermore, some embodiments perform only a subset of the operations shown in the figures.

General Operations for Switching Between Operation Modes

Figure 5:
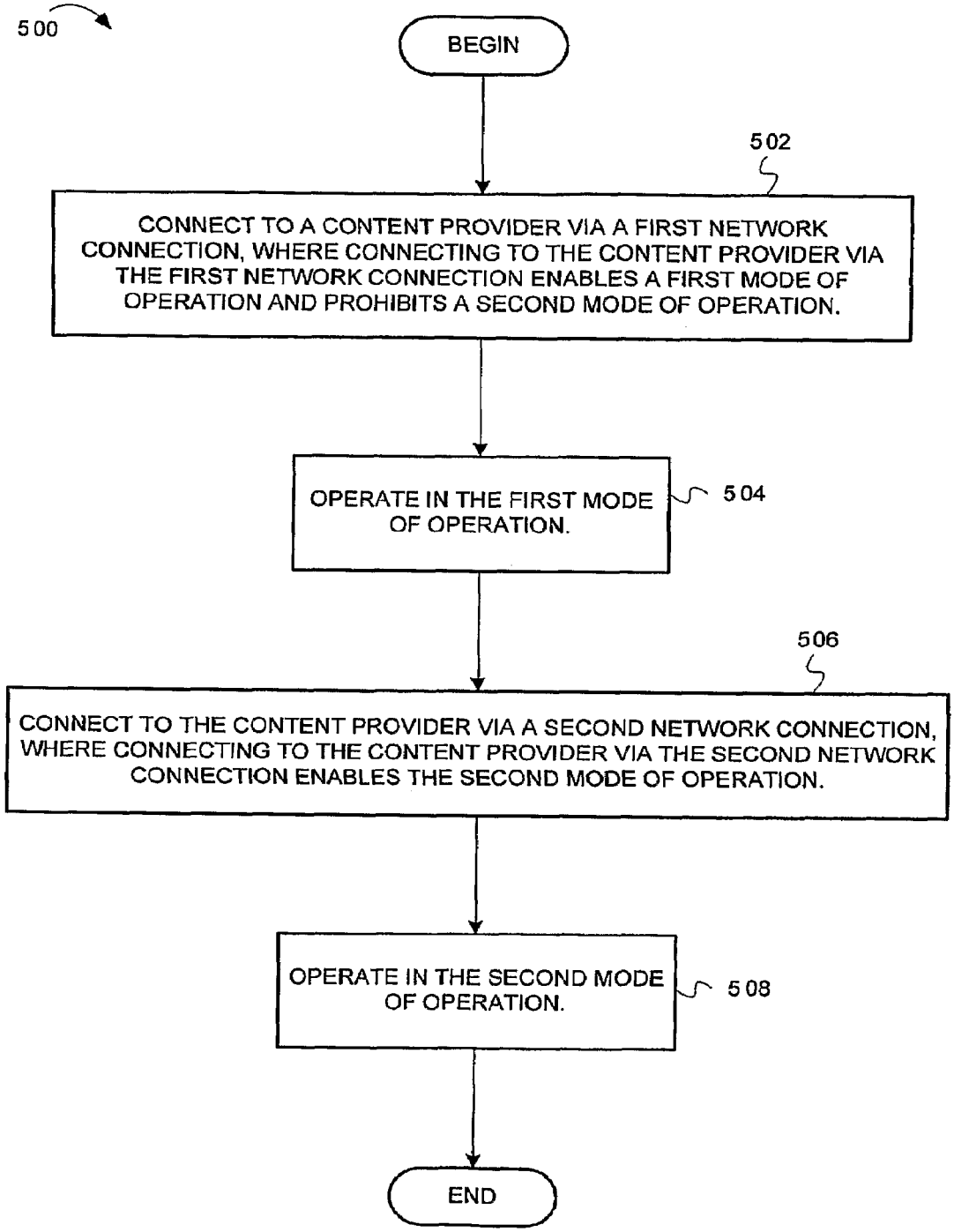
FIG. 5 is a flow diagram illustrating operations for connecting to a content provider and switching between operation modes, according to example embodiments of the invention.
Figure 6:
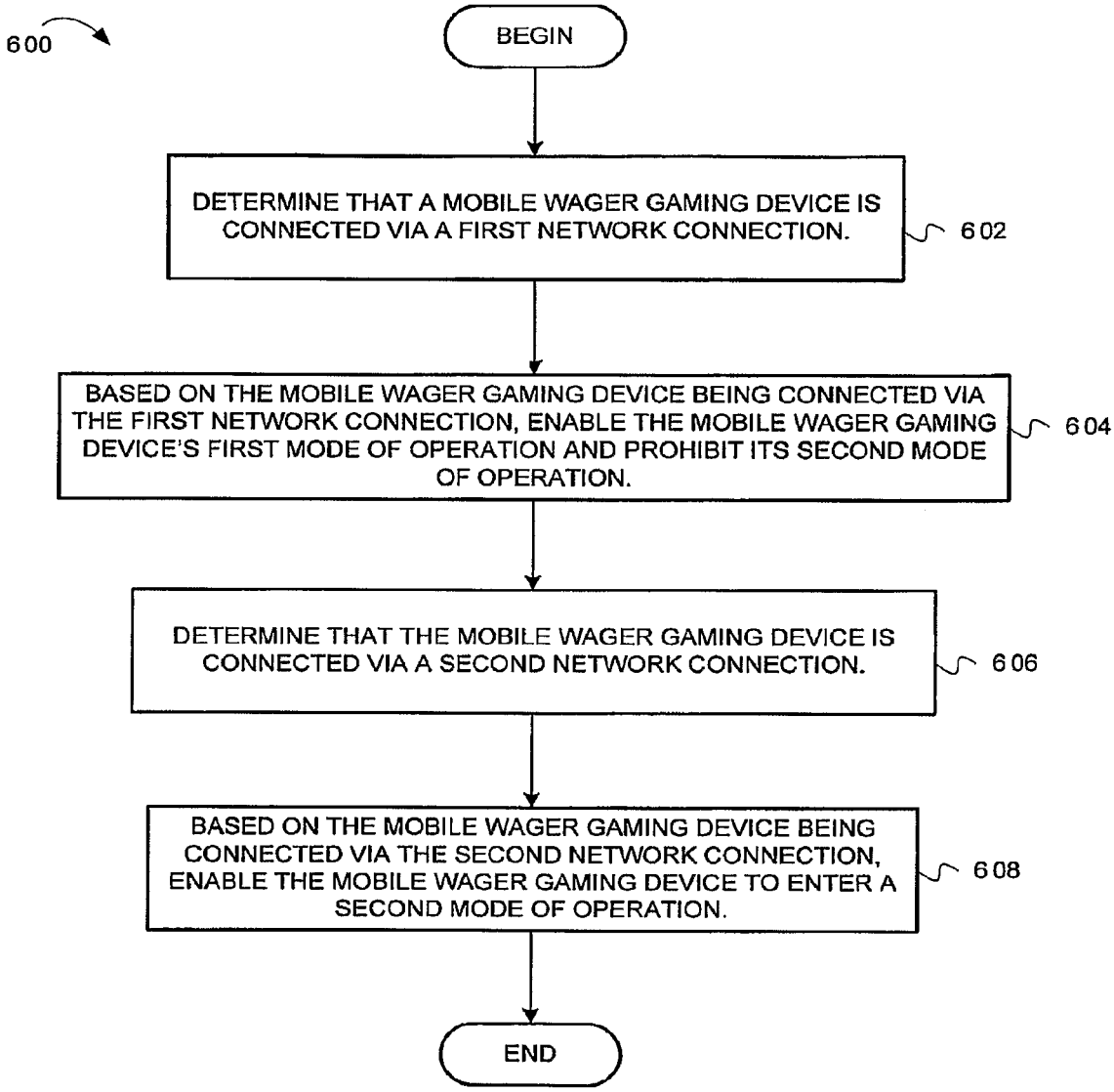
FIG. 6 is a flow diagram illustrating operations for enabling a mobile wager gaming device to switch between operation modes based on network connections, according to example embodiments of the invention.

This section presents FIGS. 5 and 6, which describe general operations for establishing a plurality of network connections and switching between operation modes based on the network connections. This description continues with FIG. 5.

FIG. 5 is a flow diagram illustrating operations for connecting to a content provider and switching between operation modes, according to example embodiments of the invention. The flow 500 begins at block 502.

At block 502, a mobile wager gaming device's network connection unit 324 connects to a content provider (e.g., content server 206) via a first network connection, where connecting to the content provider via the first network connection enables a first mode of operation and prohibits a second mode of operation. The first network connection can be a cell phone network connection (e.g., a GSM connection), IEEE 802.11g connection, Bluetooth connection, etc. In one embodiment, after establishing the first network connection, the mobile wager gaming device receives a command or other indicia allowing it to enter a first operation mode and prohibiting it to enter a second operation mode. The flow continues at block 504.

At block 504, the mobile wager gaming device 204 operates in a first mode of operation. In one embodiment, the first mode of operation is limited to non-wagering operations, such as presenting non-wagering games (e.g., amusement games) and presenting non-wagering content (e.g., non-wagering web pages). The flow continues at block 506.

At block 506, the mobile wager gaming device's network connection unit 324 connects to the content provider (e.g., content server 206) via a second network connection, where connecting to the content provider via the second network connection enables a second mode of operation. The second network connection can be a cellular network connection (e.g., a GSM connection), IEEE 802.11g connection, Bluetooth connection, etc. In one embodiment, after establishing the second network connection, the mobile wager gaming device 204 receives, from the content provider, a command or other indicia allowing it to enter a second operation mode. The flow continues at block 508.

At block 508, the mobile wager gaming device 204 operates in a second mode of operation. In one embodiment, the second mode of operation includes wagering operations, such as presenting wagering games (e.g., slots, video poker, etc.) and presenting wagering content (e.g., wagering related media). In one embodiment, the first and second operation modes do not distinguish between wagering and non-wagering operations. Instead, the first and second modes can impose other limitations, such as security, quality of service, authentication, etc. From block 508, the flow ends.

While FIG. 5 describes connecting to a content provider and switching between operation modes, FIG. 6 describes enabling a mobile wager gaming device to enter different operation modes.

FIG. 6 is a flow diagram illustrating operations for enabling a mobile wager gaming device to switch between operation modes based on network connections, according to example embodiments of the invention. The flow 600 begins at block 602.

At block 602, the content server 206 determines that a mobile wager gaming device 204 is connected via a first network connection. For example, the content server's network connection manager 436 detects that a mobile wager gaming device 204 has connected via a cellular network connection. The flow continues at block 604.

At block 604, based on the mobile wager gaming device 204 being connected via the first network connection, the content server's network connection manager 436 enables the mobile wager gaming device 204 to enter a first operation mode and prohibits it from entering a second operation mode. For example, because the mobile wager gaming device 204 is connected via a cellular connection, the content server 206 allows the mobile device 204 to perform non-wagering operations, while prohibiting it from performing wagering operations. The flow continues at block 606.

At block 606, the content server 206 determines that the mobile wager gaming device 204 is connected via a second network connection. For example, the content server's network connection manager 436 determines that a mobile wager gaming device 204 has connected via a casino's IEEE 802.11 access point. The flow continues at block 608.

At block 608, based on the mobile wager gaming device 204 being connected via the second network connection, the content server's network connection manager 436 enables the mobile wager gaming device 204 to enter a second operation mode. For example, because the mobile wager gaming device 204 is connected via a casino's 802.11 access point, the content server 206 allows the mobile device 204 to present wagering operations. From block 608, the flow ends.

Additional Embodiments for Switching Between Operation Modes

Figure 7:
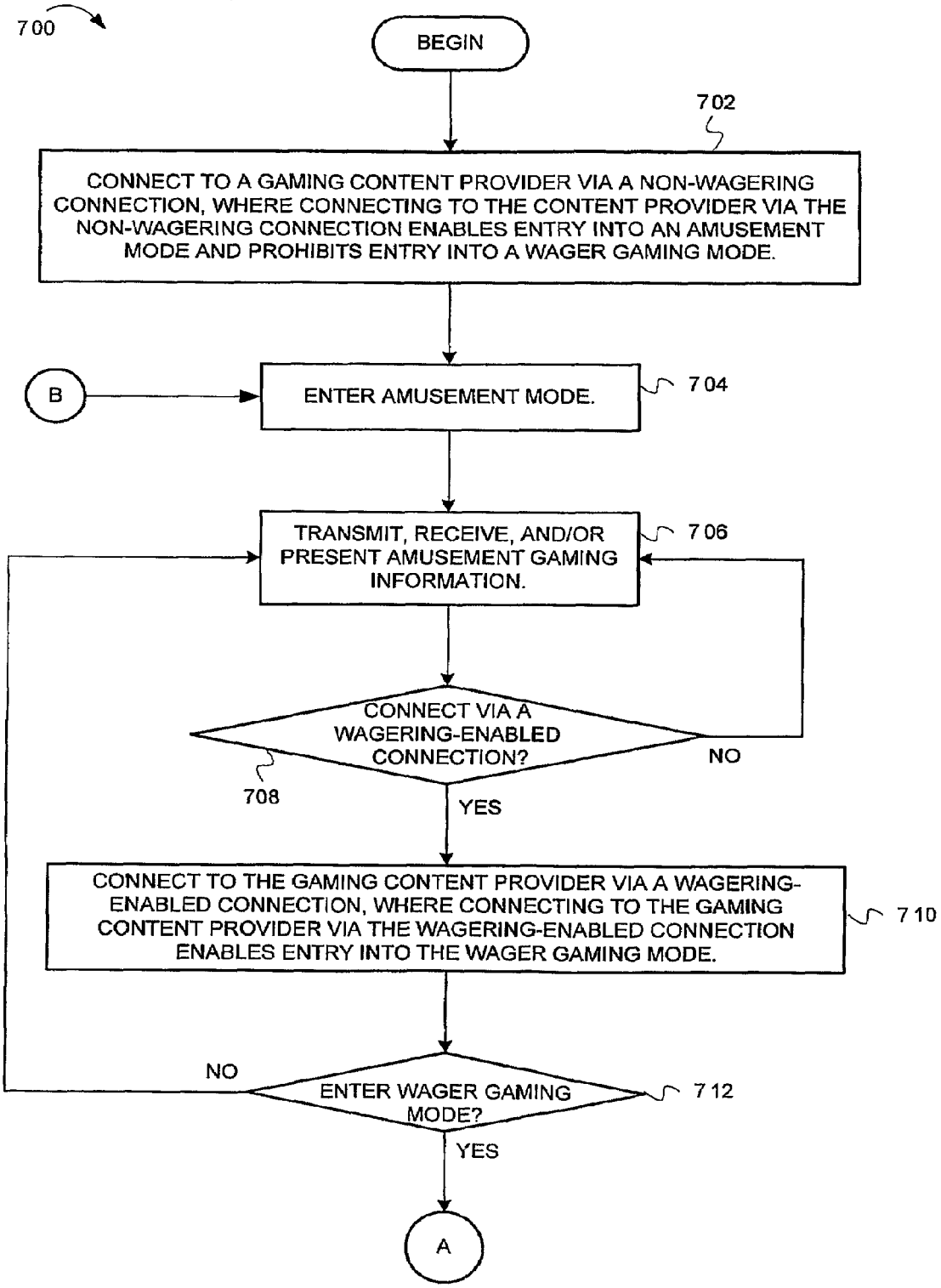
FIG. 7 is a flow diagram illustrating operations for connecting to a content provider and switching between wagering and amusement modes, according to example embodiments of the invention.
Figure 8:
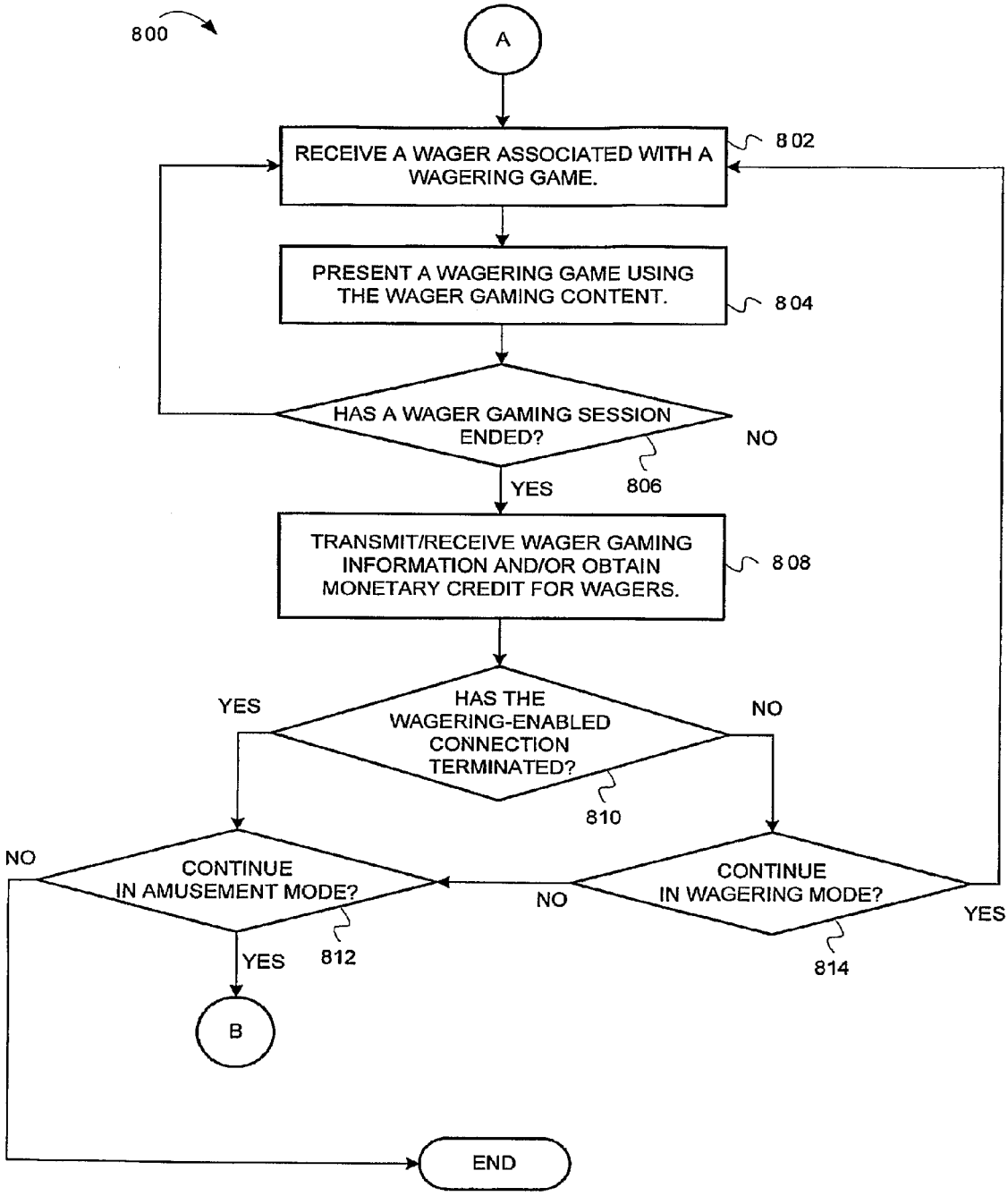
FIG. 8 is a flow diagram illustrating additional operations for connecting to a content provider and switching between wagering and amusement modes, according to example embodiments of the invention.
Figure 9:
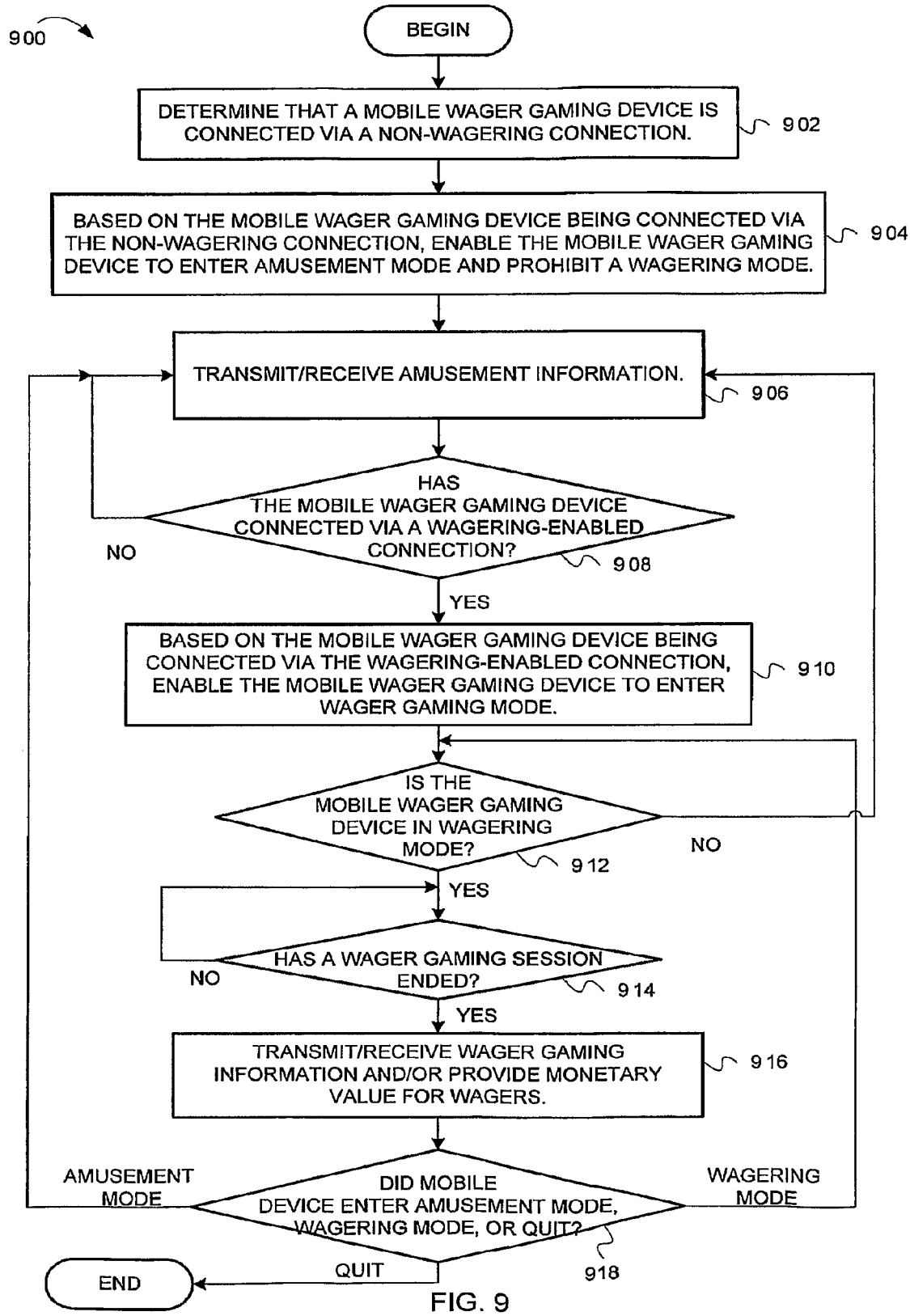
FIG. 9 is a flow diagram illustrating operations for enabling a mobile wager gaming device switch between operation modes based on network connections, according to example embodiments of the invention.

This section presents FIGS. 7-9, which describe additional embodiments for establishing a plurality of network connections and switching between operation modes based on the network connections. This description continues with FIG. 7.

FIG. 7 is a flow diagram illustrating operations for connecting to a content provider and switching between wagering and amusement modes, according to example embodiments of the invention. The flow 700 begins at block 702.

At block 702, a mobile wager gaming device's network connection unit 324 connects to a content server 206 via a non-wagering network connection. Because the mobile wager gaming device 204 is connected to the content server 206 via the non-wagering connection, the content server 206 enables the mobile wager gaming device 204 to enter and amusement mode, while prohibiting it from entering a wagering mode. The flow continues at block 704.

At block 704, the mobile wager gaming device 204 enters an amusement mode in which it can present amusement games and/or present non-wagering content, such as non-wagering related web pages. The flow continues at block 706.

At block 706, the mobile wager gaming device 204 transmits, receives, and/or presents amusement content. The flow continues at block 708.

At block 708, the mobile wager gaming device's network connection unit 324 determines whether to establish a wagering-enabled network connection. For example, the network connection unit 324 detects a wagering-enabled network and solicits user input about whether to establish a wagering-enabled connection. In one embodiment, a wagering-enabled connection is a network connection over which the mobile wager gaming device 204 can receive permission to enter a wagering mode of operation. If a wagering-enabled connection is established, the flow continues at block 710. Otherwise, the flow continues at block 706.

At block 710, the mobile wager gaming device's network connection unit 324 connects to the content server 206 via a wagering-enabled connection. Because the mobile wager gaming device 204 is connected via the wagering-enabled connection, the content server 206 has allowed it to enter into a wagering mode. The flow continues at block 712.

At block 712, a determination is made about whether to enter the wagering mode. In one embodiment, the mobile wager gaming device solicits user input about whether to enter wagering mode. If the mobile wager gaming device enters wagering mode, the flow continues at block 802 of FIG. 8. Otherwise, the flow continues at block 706.

This description continues with FIG. 8, which is a continuation of FIG. 7's flow 700. FIG. 8 is a flow diagram illustrating additional operations for connecting to a content provider and switching between wagering and amusement modes, according to example embodiments of the invention.

At block 802, the mobile wager gaming device's gaming unit 308 receives a wager of monetary value in association with a wagering game, such as slots or video poker. The flow continues at block 804.

At block 804, the gaming unit 308 presents the wagering game. For example, if the wagering game is video slots, the gaming unit 308 presents the spinning reels and game results on the primary display 310. The flow continues at block 806.

At block 806, the gaming unit 308 determines whether the wagering session has ended. In one embodiment, the gaming unit 308 makes this determination based on user input received through a graphical user interface. If the wagering session has ended, the flow continues at block 808. Otherwise, the flow continues at block 802.

At block 808, the mobile wager gaming device transmits/receives wager gaming information and/or obtains monetary credit for wagers. In one embodiment, the wagering gaming information notifies the content server 206 about the wagering games that were played and the results of those wagering games. Additionally, the mobile wager gaming device 204 can request that the content server 206 credit a player's account for wagers won during the wagering games. The flow continues at block 810.

At block 810, the mobile wager gaming device's network connection unit 324 determines whether the wagering-enabled connection has terminated. If the wagering-enabled connection has terminated, the flow continues at block 812. Otherwise, the flow continues at block 814.

At block 812, the mobile wager gaming device 204 determines whether to continue in amusement mode. In one embodiment, the mobile wager gaming device 204 solicits user input about whether to continue in amusement mode. If the mobile wager gaming device 204 will continue in amusement mode, the flow continues at block 704 of FIG. 7. Otherwise, the flow ends.

At block 814, the mobile wager gaming device 204 determines whether to continue in wagering mode. In one embodiment, the mobile wager gaming device 204 makes this determination based on user input. If the mobile wager gaming device will continue in wagering mode, the flow continues at block 802. Otherwise, the flow continues at block 812.

While FIGS. 7 and 8 describe operations performed by embodiments of a mobile wager gaming device, FIG. 9 describes operations performed by embodiments of a content provider. This description continues with a discussion of FIG. 9.

FIG. 9 is a flow diagram illustrating operations for enabling a mobile wager gaming device to switch between operation modes based on network connections, according to example embodiments of the invention. The flow 900 begins at block 902.

At block 902, a content server's network connection manager 436 determines that a mobile wager gaming device 204 is connected via a non-wagering connection (e.g., a cellular network connection). The flow continues at block 904.

At block 904, based on a mobile wager gaming device 204 being connected via the non-wagering connection, the network connection manager 436 enables the mobile wager gaming device 204 to enter an amusement mode and prohibits the mobile device 204 from entering a wagering mode. The flow continues at block 906.

At block 906, the content server 206 transmits/receives amusement information to/from the mobile wager gaming device 204. For example, the content server 206 transmits non-wagering web pages and/or other content to the mobile wager gaming device 204. Additionally, the content server 206 receives non-wagering related information, such as amusement game results, web page requests, etc. The flow continues at block 908.

At block 908, the content server 206 determines whether the mobile wager gaming device is connected via a wagering-enabled connection. In one embodiment, a casino's 802.11g or Bluetooth connection can be wagering-enabled connections. In one embodiment, the network connection manager 436 has access to a table that enumerates wagering-enabled connections. If a mobile wager gaming device is connected via a wagering-enabled connection, the flow continues at block 910. Otherwise, the flow continues at block 906.

At block 910, based on a mobile wager gaming device 204 being connected via the wagering-enabled connection, the network connection manager 436 enables the mobile wager gaming device 204 to enter a wagering mode. The flow continues at block 912.

At block 912, the network connection manager 436 determines whether the mobile wager gaming device 204 is in a wagering mode. In one embodiment, when the mobile wager gaming device 204 enters a wagering mode, the network connection manager 436 receives a message from the mobile wager gaming device 204. If the mobile wager gaming device 204 is in wagering mode, the flow continues at block 914. Otherwise, the flow continues at block 906.

At block 914, the network connection manager 436 determines whether a wager gaming session has ended. In one embodiment, when a wager gaming session has ended, the network connection manager 436 receives a message from the mobile wager gaming device 204. If a wager gaming session has ended, the flow continues at block 916. Otherwise, the flow continues at block 914.

At block 916, the content server 206 transmits/receives wager gaming information and/or provides monetary value for wagers. In one embodiment, the content server 206 receives an indication of what wagering games were played and results of those games. The flow continues at block 918.

At block 918, the content server 206 determines whether the mobile wager gaming device 204 entered amusement mode, wagering mode, or quit. In one embodiment, when the mobile wager gaming device 204 enters a different mode, the network connection manager 436 receives a message indicating the mode change. If the mobile wager gaming device 204 enters the amusement mode, the flow continues at block 906. If the mobile device 204 enters wagering mode, the flow continues at block 912. Otherwise, the flow 900 ends.

Tiered Networks

This section describes operations for exchanging different content types over different network connections. The embodiments described in this section can be combined with embodiments described in other sections.

Figure 10:
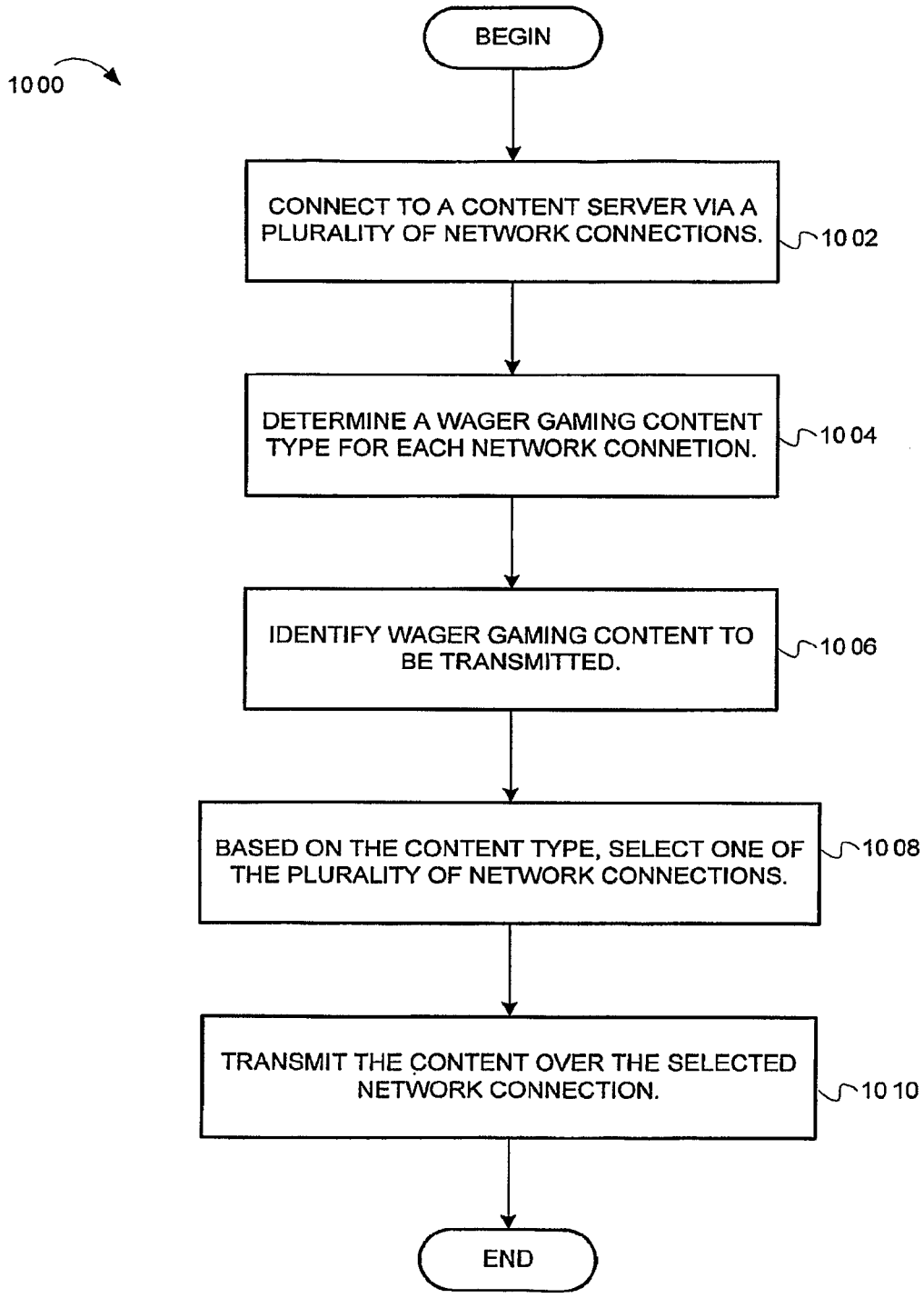
FIG. 10 is a flow diagram illustrating operations for exchanging different content types over different network connections, according to example embodiments of the invention.

FIG. 10 is a flow diagram illustrating operations for exchanging different content types over different network connections, according to example embodiments of the invention. In one embodiment, the operations of the flow 1000 are performed by a mobile wager gaming device. The flow 1000 begins at block 1002.

At block 1002, a mobile wager gaming device 204 connects to a content server 206 via a plurality of network connections. For example, the mobile device 204 connects to a content server 206 over Bluetooth, 802.11g, GSM, and other connections. The flow continues at block 1004.

At block 1004, the mobile wager gaming device's network connection unit 324 determines a content type for each network connection. In one embodiment, the network connection unit 324 receives from the content server 206 an indication about what content types should be transmitted on each network connection. In another embodiment, the mobile wager gaming device itself determines a content type for each network connection. Different factors can dictate which content types can be transmitted over each network connection. For example:

- Security-sensitive content (e.g. wagering content) may be confined to encrypted 802.11 or Bluetooth network connections.
- Bandwidth-sensitive content (e.g., streaming video) may be confined to 802.11 network connections.
- Power consumption constraints may dictate that most content be transmitted over Bluetooth connections.

In addition to these factors, any number of other factors can affect what content types are transmitted over the network connections. The flow continues at block 1006.

At block 1006, the mobile wager gaming device's network connection unit 324 identifies content to be transmitted. For example, during a wager gaming session, the network connection unit 324 receives from the gaming unit 308 wager gaming information (e.g., player input identifying wager amounts) for transmission to the content server 206. The flow continues at block 1008.

At block 1008, the network connection unit 324 selects, based on the content type, one of the plurality of network connections. For example, the network connection unit 324 selects a casino's encrypted 802.11g network. The flow continues at block 1010.

At block 1010, the network connection unit 324 transmits the content over be selected network connection (e.g., the casino's 802.11g network). From block 1010, the flow ends.

Figure 11:
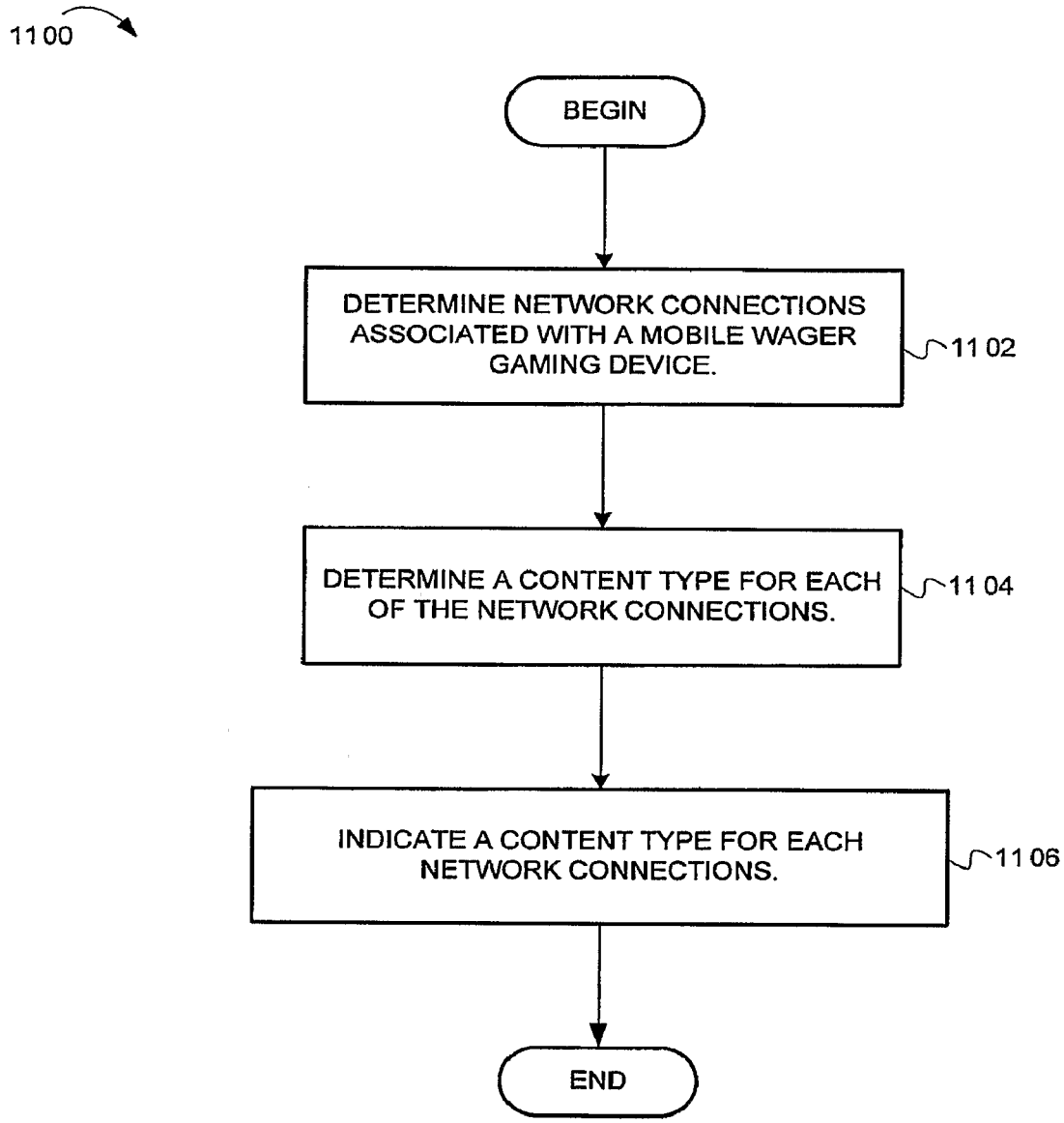
FIG. 11 is a flow diagram illustrating operations for determining a content type for each of the plurality of network connections, according to example embodiments of the invention.

While FIG. 10 describes operations performed by embodiments of a mobile wager gaming device, FIG. 11 describes operations performed by embodiments of a content server.

FIG. 11 is a flow diagram illustrating operations for determining a content type for each of the plurality of network connections, according to example embodiments of the invention. The flow begins at block 1102.

At block 1102, a content server's network connection manager 436 determines what network connections have been established by a mobile wager gaming device 204. The flow continues at block 1104.

At block 1104, the network connection manager 436 determines a content type for each of the network connections. For example, network connection manager 436 determines that security-sensitive content should be transmitted over encrypted 802.11 connections, bandwidth-sensitive content should be transmitted over 802.11 connections, and all other content should be transmitted over Bluetooth connections. The network connection manager 436 can make different determinations based on different factors, as noted above. The flow continues at block 1106.

At block 1106, the content server's network connection manager 436 indicates a content type for each network connection. For example, the network connection manager 436 transmits to the mobile wager gaming device 204 a message indicating the content type for each network connection. Alternatively, the network connection manager 436 stores a content/connection indication in a data store accessible to the mobile wager gaming device 204. From block 1106, the flow ends.

Example Mobile Wager Gaming Device and Wager Gaming Machine

Mobile Wager Gaming Device

Figure 12:
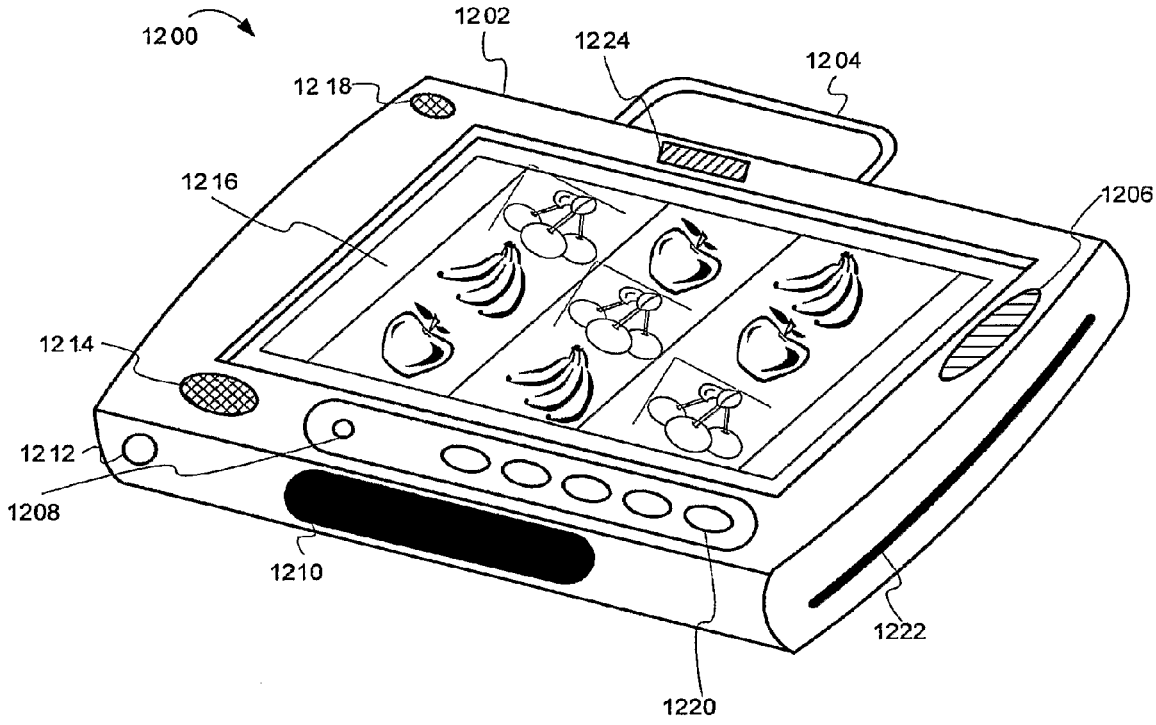
FIG. 12 is a perspective view of a mobile wager gaming device, according to example embodiments of the invention.

FIG. 12 is a perspective view of a mobile wager gaming device, according to example embodiments of the invention. As shown in FIG. 12, the mobile wager gaming device 1200 includes a housing 1202 for containing internal hardware and/or software such as that described above vis-à-vis FIG. 3. In one embodiment, the housing has a form factor similar to a tablet PC, while other embodiments have different form factors. For example, the mobile wager gaming device 1200 can exhibit smaller form factors, similar to those associated with personal digital assistants. In one embodiment, a handle 1204 is attached to the housing 1202. Additionally, the housing may store a foldout stand 1210, which can hold the mobile wager gaming device 1200 upright or semi-upright on a table or other surface.

The mobile wager gaming device 1200 can includes several input/output devices. In one embodiment, the mobile wager gaming device 1200 includes buttons 1220, audio jack 1208, speaker 1214, display 1216, biometric device 1206, wireless transmission devices 1212 and 1224, microphone 1218, and card reader 1222. Additionally, the mobile wager gaming device 1200 can include tilt, orientation, ambient light, or other environmental sensors.

In one embodiment, the mobile wager gaming device 1200 uses the biometric device 1206 for authenticating players, whereas it uses the display 1216 and speakers 1214 for presenting wagering game results and other information (e.g., credits, progressive jackpots, etc.). The mobile wager gaming device 1200 can also present audio through the audio jack 1208 or through a wireless link such as Bluetooth.

In one embodiment, the wireless communication unit 1212 can include infrared wireless communications technology for receiving wager gaming content while docked in a docking station (not shown). The wireless communication unit 1224 can include an 802.11G, Bluetooth, Global System for Communications (GSM), and other transceivers for wirelessly connecting to a content provider via various network connections.

The mobile wager gaming device 1200 can include a docking port (not shown), which can include surface-contact charging pads or other facilities for recharging the mobile wager gaming device's battery (not shown). The docking port can also include a network interface (e.g., Ethernet interface) through which a docking station can communicate with and test the mobile wager gaming device 1200.

In one embodiment, the mobile wager gaming device 1200 is constructed from damage resistant materials, such as polymer plastics. Portions of the mobile wager gaming device 1200 can be constructed from non-porous plastics which exhibit antimicrobial qualities. Also, the unit 1200 can be liquid resistant for easy cleaning and sanitization.

Wager Gaming Machine

Figure 13:
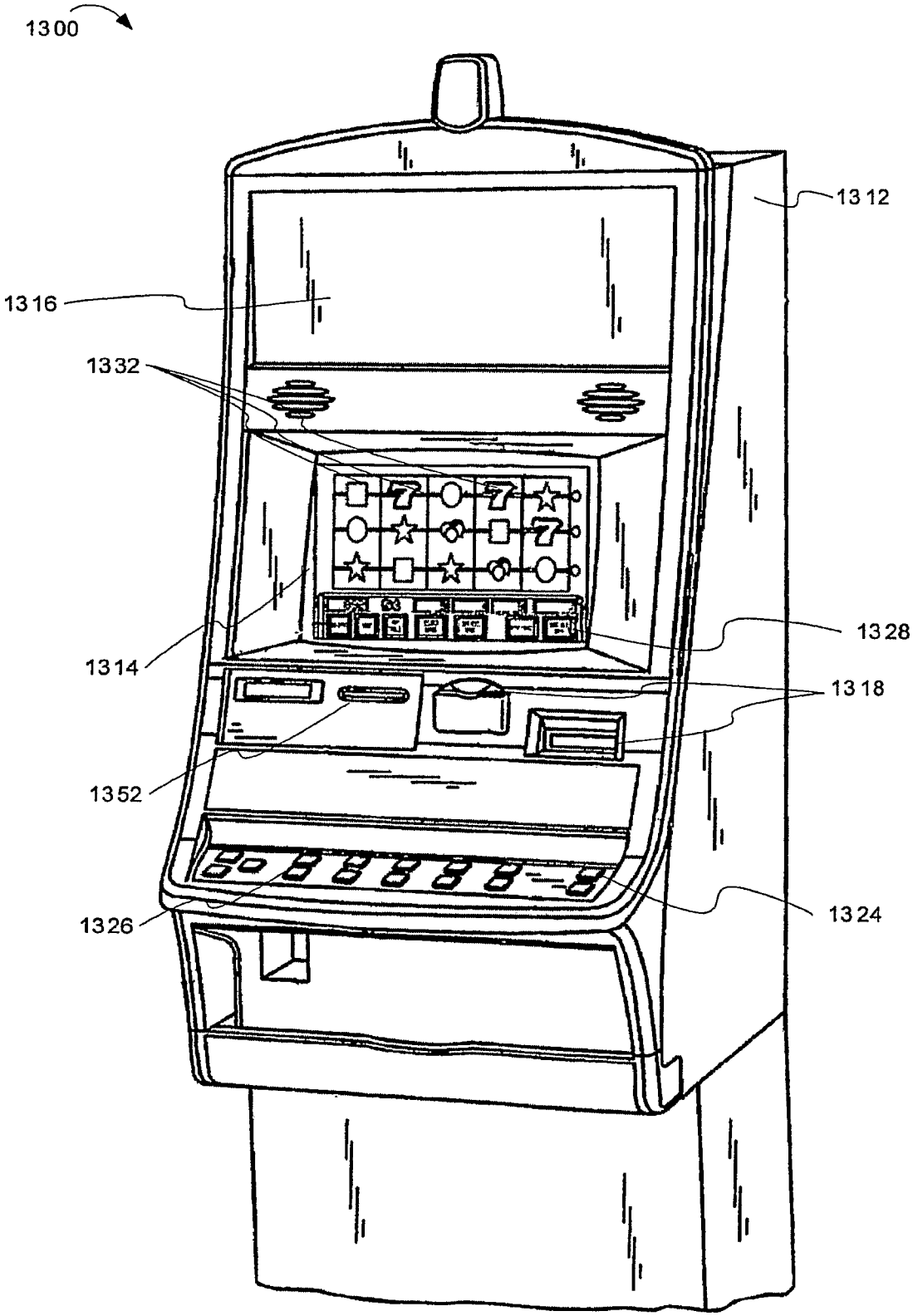
FIG. 13 is a perspective view of a wager gaming machine, according to example embodiments of the invention.

FIG. 13 is a perspective view of a wager gaming machine, according to example embodiments of the invention. Referring to FIG. 13, a wager gaming machine 1300 is used in gaming establishments, such as casinos. According to embodiments, the wager gaming machine 1300 can be any type of wager gaming machine and can have varying structures and methods of operation. For example, the wager gaming machine 1300 can be an electromechanical wager gaming machine configured to play mechanical slots, or it can be an electronic wager gaming machine configured to play video casino games, such as blackjack, slots, keno, poker, blackjack, roulette, etc.

The wager gaming machine 1300 comprises a housing 1312 and includes input devices, including value input devices 318 and a player input device 324. For output, the wager gaming machine 1300 includes a primary display 1314 for displaying information about a basic wagering game. The primary display 1314 can also display information about a bonus wagering game and a progressive wagering game. The wager gaming machine 1300 also includes a secondary display 1316 for displaying wagering game events, wagering game outcomes, and/or signage information. While some components of the wager gaming machine 1300 are described herein, numerous other elements can exist and can be used in any number or combination to create varying forms of the wager gaming machine 1300.

The value input devices 1318 can take any suitable form and can be located on the front of the housing 1312. The value input devices 1318 can receive currency and/or credits inserted by a player. The value input devices 1318 can include coin acceptors for receiving coin currency and bill acceptors for receiving paper currency. Furthermore, the value input devices 1318 can include ticket readers or barcode scanners for reading information stored on vouchers, cards, or other tangible portable storage devices. The vouchers or cards can authorize access to central accounts, which can transfer money to the wager gaming machine 1300.

The player input device 1324 comprises a plurality of push buttons on a button panel 326 for operating the wager gaming machine 1300. In addition, or alternatively, the player input device 1324 can comprise a touch screen 1328 mounted over the primary display 1314 and/or secondary display 1316.

The various components of the wager gaming machine 1300 can be connected directly to, or contained within, the housing 1312. Alternatively, some of the wager gaming machine's components can be located outside of the housing 1312, while being communicatively coupled with the wager gaming machine 1300 using any suitable wired or wireless communication technology.

The operation of the basic wagering game can be displayed to the player on the primary display 1314. The primary display 1314 can also display a bonus game associated with the basic wagering game. The primary display 1314 can include a cathode ray tube (CRT), a high resolution liquid crystal display (LCD), a plasma display, light emitting diodes (LEDs), or any other type of display suitable for use in the wager gaming machine 1300. Alternatively, the primary display 1314 can include a number of mechanical reels to display the outcome. In FIG. 13, the wager gaming machine 1300 is an "upright" version in which the primary display 1314 is oriented vertically relative to the player. Alternatively, the wager gaming machine can be a "slant-top" version in which the primary display 1314 is slanted at about a thirty-degree angle toward the player of the wager gaming machine 1300. In yet another embodiment, the wager gaming machine 1300 can be a bartop model, a mobile handheld model, or a workstation console model.

A player begins playing a basic wagering game by making a wager via the value input device 1318. The player can initiate play by using the player input device's buttons or touch screen 1328. The basic game can include arranging a plurality of symbols along a payline 1332, which indicates one or more outcomes of the basic game. Such outcomes can be randomly selected in response to player input. At least one of the outcomes, which can include any variation or combination of symbols, can trigger a bonus game.

In some embodiments, the wager gaming machine 1300 can also include an information reader 1352, which can include a card reader, ticket reader, bar code scanner, RFID transceiver, or computer readable storage medium interface. In some embodiments, the information reader 1352 can be used to award complimentary services, restore game assets, track player habits, etc.

General

In the detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Each of the embodiments described herein are contemplated as falling within the inventive subject matter, which is set forth in the following claims.

The invention claimed is:

1. A method comprising:

connecting a mobile wagering game device to a content provider via a cellular phone network connection, wherein connecting to the content provider via the cellular phone network connection enables a first mode of operation on the mobile wagering game device;

based on the mobile wagering game device being connected to the content provider via the cellular phone network connection, operating the mobile wagering game device in the first mode of operation, wherein operating in the first mode of operation includes presenting a non-wagering game on the mobile wagering game device and prohibiting presentation of wagering games on the mobile wagering game device;

connecting the mobile wagering game device to the content provider via a non-cellular phone network connection, wherein connecting to the content provider via the non-cellular phone network connection enables a second mode of operation; and based on the mobile wagering game device being connected to the content provider via the non-cellular phone network connection, operating the mobile wagering game device in the second mode of operation, wherein the operating includes presenting a wagering game upon which monetary value can be wagered on the mobile wagering game device.

2. The method of claim 1, wherein the second mode of operation is not available absent the connecting via the non-cellular phone network connection.

3. The method of claim 1, wherein the cellular phone network connection includes a Global System for Communications (GSM) network connection.

4. The method of claim 1, wherein the non-cellular phone network connection includes an Institute for Electronics and Electrical Engineers (IEEE) 802.11 network connection or a Bluetooth network connection.

5. The method of claim 1 wherein the non-wagering game is an amusement form of the wagering game.

6. The method of claim 1, wherein the second mode of operation is enabled or prohibited by the content provider.

7. The method of claim 1, wherein results of the wagering game are determined by the content provider.

8. The method of claim 1, further comprising:

presenting a notification that the second mode of operation is available;

receiving a mode selection indicating the second mode of operation; and switching from the first mode of operation to the second mode of operation.

9. A non-transitory machine-readable medium including instructions, which when executed by a machine, cause the machine to perform operations comprising:

determining that a mobile wager gaming device is connected via a cellular phone network connection;

based on the mobile wager gaming device being connected via the cellular phone network connection, enabling the mobile wager gaming device to operate according to a first mode of operation and prohibiting the mobile wager gaming device from operating according to a second mode of operation, wherein the first mode of operation includes presenting a non-wagering game on the mobile wagering game device and the second mode of operation includes presenting a wagering game upon which monetary value can be wagered on the mobile wagering game device;

determining that the mobile wager gaming device is connected via a non-cellular phone network connection; and based on the mobile wager gaming device being connected via the non-cellular phone network connection, enabling the mobile wager gaming device to operate according to the second mode of operation.

10. The non-transitory machine-readable medium of claim 9, wherein the second mode of operation includes receiving wagers in association with wagering games.

11. The non-transitory machine-readable medium of claim 9, wherein the second mode of operation is allowed or prohibited based on gambling laws or copyright laws.

12. The non-transitory machine-readable medium of claim 9, the operations further comprising:

while the mobile wager gaming device is operating according to the second mode of operation, processing a wager associated with a wagering game.

13. The non-transitory machine-readable medium of claim 9, wherein enabling the mobile wager gaming device to operate according to the first mode of operation includes transmitting non-wagering content destined for the mobile wager gaming device, and wherein enabling the mobile wager gaming device to operate according to the second mode of operation includes transmitting wagering content destined for the mobile wager gaming device.

14. The non-transitory machine-readable medium of claim 9, wherein the cellular phone network connection includes a Global System for Communications (GSM) network connection.

15. The non-transitory machine-readable medium of claim 9, wherein the non-cellular phone network connection includes an Institute for Electronics and Electrical Engineers (IEEE) 802.11 network connection or a Bluetooth network connection.

16. A mobile wager gaming device comprising:

a network connection unit configured to connect to a content provider via a plurality of network connections, the network connection unit operable to:

determine if the mobile wagering game device is connected to the content provider using a non-cellular phone network and if so entering a wagering mode of operation of the mobile wagering game device; and determine if the mobile wagering game device is connected to the content provider via a cellular phone network and if so entering a non-wagering mode of operation of the mobile wagering gaming device and prohibiting presentation of wagering games on the mobile wagering game device; and a gaming unit configured to present non-wagering content on the mobile wagering game device when not in the wagering mode of operation, the wager gaming unit also configured to receive wagers and present wagering games when in the wagering mode of operation.

17. The mobile wager gaming device of claim 16, the network connection unit further configured to transmit and receive a different one of many content types over each of the plurality of network connections.

18. The mobile wager gaming device of claim 17, wherein the different ones of the many content types are assigned to ones of the plurality of network connections based on security requirements, bandwidth needs, or power constraints.

19. The mobile wager gaming device of claim 16, wherein the plurality of network connections includes a Global System for Communications (GSM) network connection, an Institute for Electronics and Electrical Engineers (IEEE) 802.11 network connection, or a Bluetooth network connection.

20. The mobile wager gaming device of claim 16, wherein the non-wagering content includes amusement games.

21. A non-transitory machine-readable medium including instructions, which when executed by a machine, cause the machine to perform operations comprising:

determining that a mobile wager gaming device is connected via a cellular phone network connection;

based on the mobile wager gaming device being connected via the cellular phone network connection, enabling transmission of amusement content and prohibiting transmission of wagering game content;

determining that the mobile wager gaming device is connected via a non-cellular phone network connection; and based on the mobile wager gaming device being connected via the non-cellular phone network connection, enabling transmission of wagering game content.

22. The non-transitory machine-readable medium of claim 21, wherein the wagering game content includes a result of a wagering game.

23. The non-transitory machine-readable medium of claim 21, wherein the cellular phone network connection uses a Global System for Communications (GSM) protocol and the non-cellular phone network connection utilize protocols from at least one of Institute for Electronics and Electrical Engineers (IEEE) 802.11 protocol or Bluetooth protocol.

* * * * *

UNITED STATES PATENT AND TRADEMARK OFFICE

CERTIFICATE OF CORRECTION

PATENT NO. : 8,152,634 B2
APPLICATION NO. : 12/295395
DATED : April 10, 2012
INVENTOR(S) : Mark B. Gagner et al.

It is certified that error appears in the above-identified patent and that said Letters Patent is hereby corrected as shown below:

On Sheet 10 of 13, Reference Numeral 1004, Figure 10, line 2, delete "CONNETION." and insert -- CONNECTION. --, therefor.

Signed and Sealed this
Eleventh Day of September, 2012

David J. Kappos

David J. Kappos
*Director of the United States Patent and Trademark Office*